US007594989B2

(12) United States Patent
Varadaraj et al.

(10) Patent No.: US 7,594,989 B2
(45) Date of Patent: Sep. 29, 2009

(54) ENHANCED THERMAL UPGRADING OF HEAVY OIL USING AROMATIC POLYSULFONIC ACID SALTS

(75) Inventors: Ramesh Varadaraj, Flemington, NJ (US); Leo D. Brown, Baton Rouge, LA (US)

(73) Assignee: ExxonMobile Research and Engineering Company, Annandale, NJ (US)

( * ) Notice: Subject to any disclaimer, the term of this patent is extended or adjusted under 35 U.S.C. 154(b) by 663 days.

(21) Appl. No.: 11/127,734

(22) Filed: May 12, 2005

(65) Prior Publication Data

US 2005/0258071 A1 Nov. 24, 2005

Related U.S. Application Data

(60) Provisional application No. 60/571,308, filed on May 14, 2004.

(51) Int. Cl.
*C10G 9/16* (2006.01)

(52) U.S. Cl. ..... 208/48 AA; 208/265; 208/282; 562/45; 562/88; 562/91; 516/20; 516/909; 210/698; 44/363

(58) Field of Classification Search ..... 208/48 AA, 208/265, 282; 44/363; 210/698; 516/20, 516/909; 562/45, 88, 91
See application file for complete search history.

(56) References Cited

U.S. PATENT DOCUMENTS 2,626,207 A * 1/1953 Glendenning et al. ..... 44/363
3,105,810 A * 10/1963 Miller et al. ..... 208/48 AA
3,617,514 A 11/1971 Marlar ..... 208/131
3,684,697 A 8/1972 Gamson ..... 208/131
3,707,459 A 12/1972 Mason et al. ..... 208/76
3,558,474 A 1/1973 Gleim et al. ..... 208/108
3,769,200 A 10/1973 Folkins ..... 208/53
3,852,047 A 12/1974 Schlinger et al. ..... 44/24
4,140,623 A 2/1979 Sooter et al. ..... 208/131
4,226,805 A 10/1980 Bauer
4,298,455 A 11/1981 Huang ..... 208/48 AA
4,399,024 A 8/1983 Fukui et al. ..... 208/131

(Continued)

FOREIGN PATENT DOCUMENTS

EP 0031697 7/1981

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—Glenn Calarola
*Assistant Examiner*—Prem C. Singh
(74) *Attorney, Agent, or Firm*—Bruce M. Bordelon; Gerald J. Hughes

(57) ABSTRACT

A method for upgrading heavy oils by contacting the heavy oil with a water-soluble aromatic polysulfonic acid salt and then thermally treating the contacted heavy oil. The polysulfonic acid salt can be recovered and recycled from contacting the heavy oil. The polysulfonic acid salt is recovered and recycled. The invention also relates to the upgraded product from the enhanced thermal treatment process.

24 Claims, 3 Drawing Sheets

U.S. PATENT DOCUMENTS

| | | | | |
|---|---|---|---|---|
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,478,729 | A | 10/1984 | Hunt et al. | |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,616,308 | A | 10/1986 | Morshedi et al. | 364/159 |
| 4,619,756 | A | 10/1986 | Dickakian | |
| 4,659,453 | A | 4/1987 | Kukes et al. | |
| 4,847,018 | A | 7/1989 | Koepke et al. | |
| 4,927,561 | A | 5/1990 | Forester | 252/389.22 |
| 4,966,679 | A | 10/1990 | Kubo et al. | |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,296,130 | A | 3/1994 | Kriz et al. | |
| 5,460,714 | A | 10/1995 | Fixari et al. | 208/112 |
| 5,645,711 | A | 7/1997 | Hraban et al. | 208/131 |
| 5,650,072 | A * | 7/1997 | Mc Clain et al. | 210/698 |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |
| 2005/0258071 | A1 * | 11/2005 | Varadaraj et al. | 208/48 AA |
| 2005/0263438 | A1 * | 12/2005 | Varadaraj et al. | 208/48 AA |

FOREIGN PATENT DOCUMENTS

| | | |
|---|---|---|
| EP | 175511 | 3/1986 |
| EP | 0839782 A1 | 5/1998 |
| GB | 1218117 | 1/1971 |
| WO | 95/14069 | 5/1995 |
| WO | 99/64540 | 12/1999 |
| WO | 03042330 | 5/2003 |
| WO | 03048271 | 6/2003 |
| WO | 2004/038316 | 5/2004 |
| WO | 2004/104139 | 12/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Development Corporation, Paulsboro, NJ. Presented as Paper 19E at the 1990 AIChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accepted Aug. 24, 1998, Elsevier Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AIChE 1998 Spring National Meeting, New Orleans, LA, Mar. 8-12, 1998.

* cited by examiner

ENHANCED THERMAL UPGRADING OF HEAVY OIL USING AROMATIC POLYSULFONIC ACID SALTS

CROSS-REFERENCE TO RELATED APPLICATION

This application claims benefit of U.S. Provisional Patent Application Ser. No. 60/571,308 filed May 14, 2004.

FIELD OF THE INVENTION

The present invention relates to a method for upgrading heavy oils by contacting the heavy oil with a water-soluble aromatic polysulfonic acid salt and then thermally treating the contacted heavy oil. The polysulfonic acid salt can be recovered and recycled after the thermal treatment of the heavy oil. The invention also relates to the upgraded product from the enhanced thermal treatment process.

BACKGROUND OF THE INVENTION

Heavy oils are generally referred to those hydrocarbon comprising oils with high viscosity or API gravity less than about 20. Crude oils and crude oil residuum obtained after atmospheric or vacuum distillation of crude oils that exhibit an API gravity less than about 20 are examples of heavy oils. Upgrading of heavy oils is important in production, transportation and refining operations. An upgraded heavy oil typically will have a higher API gravity and lower viscosity compared to the heavy oil that is not subjected to upgrading. Lower viscosity will enable easier transportation of the oil. A commonly practiced method for heavy oil upgrading is thermal treatment of heavy oil. Thermal treatment includes processes such as visbreaking and hydro-visbreaking (visbreaking with hydrogen addition). The prior art in the area of thermal treatment or additive enhanced visbreaking of hydrocarbons teach methods for improving the quality, or reducing the viscosity, of crude oils, crude oil distillates or residuum by several different methods. For example, the use of additives such as the use of free radical initiators is taught in U.S. Pat. No. 4,298,455; the use of thiol compounds and aromatic hydrogen donors is taught in EP 175511; the use of free radical acceptors is taught in U.S. Pat. No. 3,707,459; and the use of a hydrogen donor solvent is taught in U.S. Pat. No. 4,592,830. Other art teaches the use of specific catalysts, such as low acidity zeolite catalysts (U.S. Pat. No. 4,411,770) and molybdenum catalysts, ammonium sulfide and water (U.S. Pat. No. 4,659,543). Other references teach upgrading of petroleum resids and heavy oils (Murray R. Gray, Marcel Dekker, 1994, pp. 239-243) and thermal decomposition of naphthenic acids (U.S. Pat. No. 5,820,750).

Generally, the process of thermal treatment of heavy oil can result in an upgraded oil having a higher API gravity. In some instances, the sulfur and naphthenic acid content can also be reduced. However, the main drawback of thermal treatment of heavy oils is that with increased conversion there is the formation of toluene insoluble (TI) material. These toluene insoluble materials comprise organic and organometallic materials derived from certain components of the heavy oil during the thermal process. Generally, the TI materials tend to increase exponentially after a threshold conversion. Thus, the formation of TI materials limits the effectiveness of thermal upgrading of heavy oils. The presence of TI material in upgrading heavy oils is undesirable because such TI materials can cause fouling of storage, transportation and processing equipment. In addition, the TI materials can also induce incompatibility when blended with other crude oils. Increasing conversion without generating toluene insoluble material is a long-standing need in the area of thermal upgrading of heavy oils. The instant invention addresses this need. As used herein, crude oil residuum or resid refers to residual crude oil obtained from atmospheric or vacuum distillation of a crude oil or bitumen.

SUMMARY OF THE INVENTION

In one embodiment, there is provided a method for upgrading heavy oils which method comprises:

a) contacting the heavy oil with an effective amount of a water-soluble inhibitor additive to provide an inhibitor additized heavy oil, which water-soluble inhibitor additive is represented by the chemical structure:

$$Ar—(SO_3^-X^+)_n$$

Where Ar is a homonuclear aromatic group of at least 2 rings, n is an integer from 1 to 5, X is selected from Group I (alkali) and Group II (alkaline-earth) elements of the periodic table of elements and n is an integer from 1 to 5 when an alkali metal is used and from 2-10 when an alkaline earth metal is used;

b) thermally treating said inhibitor additized heavy oil at a temperature in the range of about 250° C. to 500° C. for a time between about 0.1 to 10 hours;

c) contacting said thermally treated additized heavy oil with water wherein the water-soluble inhibitor additive migrates to the water phase;

d) separating the thermally treated heavy oil from the water phase containing said water-soluble inhibitor additive;

e) separating the inhibitor additive from the water; and f) recycling said separated inhibitor additive to contacting a heavy oil in step a) above.

In a preferred embodiment the aromatic ring structure is a polynuclear ring structure comprised of about 2 to 15 aromatic rings.

In another embodiment the method of upgrading the heavy oil is performed in the presence of hydrogen.

Also in accordance with the present invention there is provided a method for upgrading a heavy oil In one embodiment, there is provided a method for upgrading heavy oils which method comprises:

a) contacting the heavy oil in the presence of hydrogen with an effective amount of a water-soluble inhibitor additive to provide an inhibitor additized heavy oil, which water-soluble inhibitor additive is represented by the chemical structure:

$$[R\text{-}PNA\text{-}(X)_n]_aM_b$$

wherein PNA is a polynuclear aromatic hydrocarbon containing 2 to 15 aromatic rings; X is a sulfonic acid functionality, n is an integer from 1 to 15 representing the number of sulfonic acid functionality on the PNA hydrocarbon; R is an alkyl group containing from 0 to 40 carbon atoms; M is an element selected from the group consisting of Group IV-B, V-B, VI-B, VII-B and VIII of the Long Form of The Periodic Table of Elements; and a and b are integers each ranging from 1 to 4.

b) thermally treating said inhibitor additized heavy oil at a temperature in the range of about 250° C. to 500° C. for a time between about 0.1 to 10 hours;

c) contacting said thermally treated additized heavy oil with water wherein the water-soluble inhibitor additive migrates to the water phase;

d) separating the thermally treated heavy oil from the water phase containing said water-soluble inhibitor additive;

e) separating the inhibitor additive from the water; and f) recycling said separated inhibitor additive to contacting a heavy oil in step a) above.

DETAILED DESCRIPTION OF THE INVENTION

Figure 1:
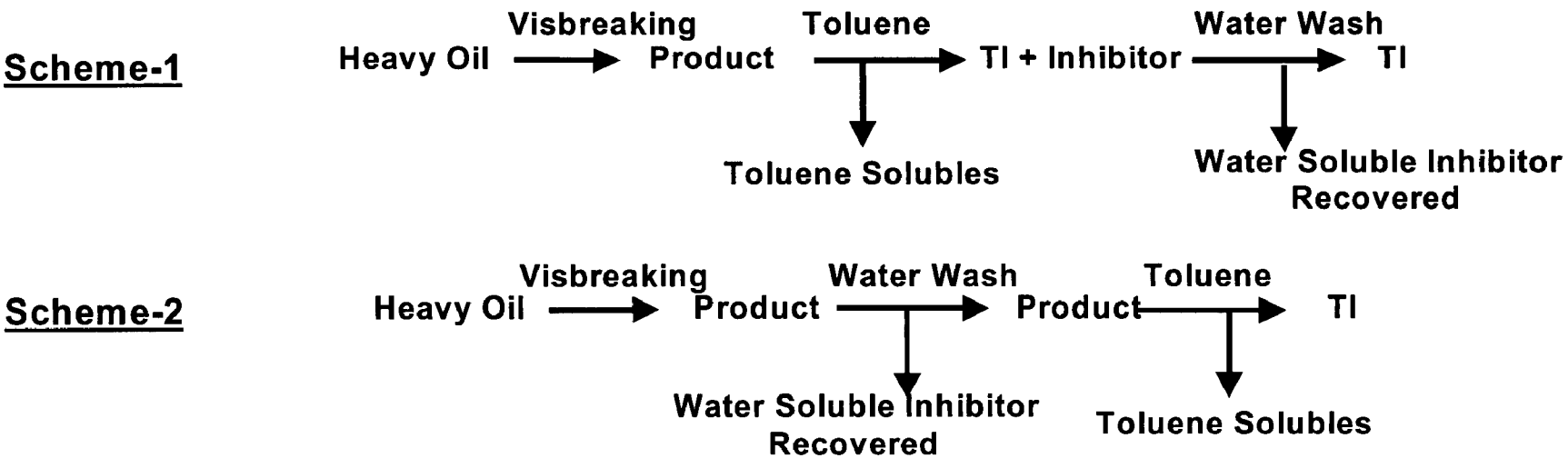
FIG. 1 hereof is a schematic of Run 1 and Run 2 of Example 2 shown as scheme-1 and scheme-2 respectively.

According to one embodiment of the invention, there is provided a method for upgrading heavy oils, such as petroleum crudes and crude oil atmospheric residuum, and vacuum residuum using an aromatic polysulfonic acid salt of the present invention. An effective amount of the aromatic polysulfonic acid salt is added to the heavy oil followed by thermal treatment at temperatures in the range of about 250° C. to 500° C. for about 30 seconds to 6 hours, thereby resulting in an upgraded heavy oil. The aromatic polysulfonic acid salt is often referred to herein as an inhibitor additive.

As previously mentioned, the preferred inhibitor additive of the present invention is an aromatic polysulfonic acid salt of the chemical structure:

$$Ar—(SO_3^-X^+)_n$$

where Ar is a homonuclear aromatic group of at least 2 rings, n is an integer from 1 to 5, and X is selected from Group I (alkali) and Group II (alkaline-earth) elements of the periodic table of elements and n is an integer from 1 to 5 when an alkali metal is used and from 2-10 when an alkaline earth metal is used. Preferably X is selected from the alkali metals, preferably sodium or potassium and mixtures thereof. Group I and Group II refer to the groups of the Periodic Table of Elements. Preferably X is selected from the alkali metals, more preferably sodium. It is also preferred that Ar have from about 2 to 15 rings, more preferably from about 2 to 4 rings, and most preferably from about 2 to 3 rings. It is within the scope of this invention that the aromatic polysulfonic acid salts of the present invention be prepared from the polysulfonation of a light catalytic cycle oil. Light catalytic cycle oil is a complex combination of hydrocarbons produced by the distillation of products from the fluidized catalytic cracking (FCC) process with carbon numbers in the range of about $C_9$ to about $C_{25}$, boiling in the range of about 340° F. (171° C.) to 700° F. (371° C.). Light catalytic cycle oil is also referred to herein as light cat cycle oil or LCCO. LCCO is generally rich in 2-ring aromatic molecules. LCCO from a US refinery typically comprises about 80% aromatics. The aromatics are typically 33% 1-ring aromatics and 66% 2-ring aromatics. Further, the 1- and 2-ring aromatics can be methyl, ethyl and propyl substituted. The methyl group is the major substituent. Nitrogen and sulfur containing heterocycles, such as indoles, quinolines and benzothiophenes are also present in minor quantities.

Non-limiting examples of preferred polysulfonic aromatic acid salts of the present invention are shown below.

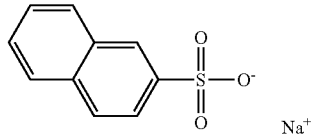

naphthalene-2-sulfonic acid sodium salt

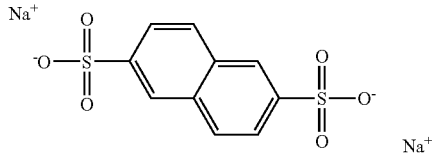

naphthalene-2,6-disulfonic acid sodium salt

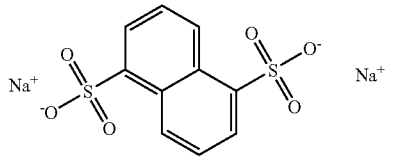

naphthalene-1,5-disulfonic acid sodium salt

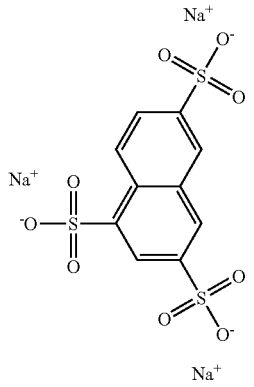

naphthalene-1,3,6-trisulfonic acid sodium salt

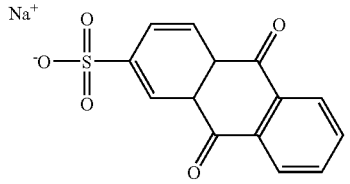

anthraquinone-2-sulfonic acid sodium salt

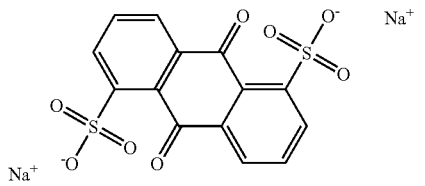

anthraquinone-1,5-disulfonic acid sodium salt and

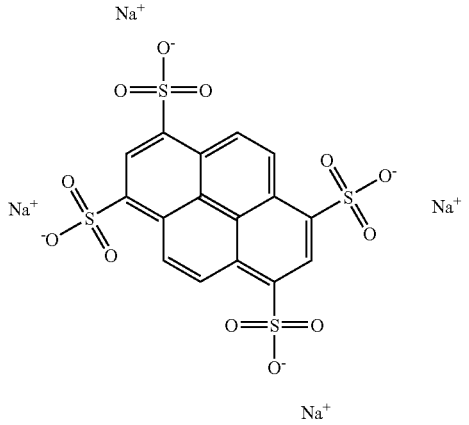

pyrene-1,3,6,8-tetra sulfonic acid sodium salt

The polysulfonic acid compositions can be produced from LCCO by a process that generally includes the polysulfonation of the LCCO with a stoichiometric excess of sulfuric acid at effective conditions. Conventional sulfonation of petroleum feedstocks typically use an excess of the petroleum feedstock—not an excess of sulfuric acid. It has unexpectedly been found by the inventors hereof that when a stoichiometric excess of sulfuric acid is used to sulfonate an LCCO the resulting polysulfonated product has novel properties and uses. The aromatic polysulfonic acid is converted to the aromatic polysulfonic acid salt by treatment with an amount of caustic to neutralize the acid functionality. The LCCO polysulfonic acid composition can best be described as a mixture of 1- and 2-ring aromatic cores with one or more sulfonic acid groups per aromatic core. The aromatic cores are methyl, ethyl, and propyl substituted, with the methyl group being the more preferred substituent.

Typically, the amount of inhibitor additive added can be about 10 to about 50,000 wppm, preferably about 20 to 3000 wppm, and more preferably 20 to 1000 wppm based on the amount of crude oil or crude oil residuum. The inhibitor additive can be added as is or in a suitable carrier solvent, preferably water or water-alcohol mixtures as the carrier solvent. Preferred alcohols are methanol, ethanol, propanol and mixtures thereof. The carrier solvent is preferably 10 to 80 weight percent of the mixture of additive and carrier solvent.

Contacting the inhibitor additive with the heavy oil can be achieved at any time prior to the thermal treatment. Contacting can occur at the point where the heavy oil is produced at the reservoir, during transportation or at a refinery location. In the case of crude oil resids, the inhibitor additive is contacted at any time prior to thermal treatment. After contacting, it is preferred to mix the heavy oil and additive. Any suitable mixing means conventionally known in the art can be used. Non-limiting examples of such suitable mixers include in-line static mixers and paddle mixers. The contacting of the heavy oil and additive can be conducted at any temperature in the range of 10° C. to 90° C. After contacting and mixing the heavy oil and additive, the mixture can be cooled from about contacting temperature to about ambient temperature, i.e., about 15° C. to 30° C. Further, the additized-cooled mixture can be stored or transported from one location to another location prior to thermal treatment. Alternately, the additized and cooled mixture can be thermally treated at the location of contacting if so desired.

Thermal treatment of the additized heavy oil comprises heating the oil to temperatures in the range of about 250° C. to 500° C. for about 30 seconds to 6 hours. Process equipment, such as visbreakers, can be advantageously employed to conduct the thermal treatment. It is preferred to mix the additized heavy oil during thermal treatment using mixing means known to those having ordinary skill in the art. It is also preferred to conduct the thermal treatment process in an inert environment. Using inert gases such as nitrogen or argon gas in the reactor vessel can provide such an inert environment The inhibitor enhanced thermal upgrading process provides a thermally upgraded product that is higher in API gravity compared to the starting feed and lower in toluene insoluble material compared to a thermally upgraded product that is produced in the absence of the inhibitor additive of the instant invention. The inhibitor additive of the instant invention inhibits the formation of toluene insoluble material while facilitating thermal conversion, such as thermal cracking, to occur in a facile manner. The thermally upgraded product of the process of the instant invention has at least 20% less toluene insoluble material compared to the product from a thermally upgraded process conducted at the same temperature for the same period of time, but in the absence of the inhibitor additive. The thermally upgraded product of the process of the instant invention has at least 15 API units higher compared to the product from a thermally upgraded process conducted at the same temperature for the same period of time, but in the absence of the inhibitor additive. The upgraded oil of the instant invention comprises the upgraded heavy oil, the added inhibitor additive and products, if any, formed from the added inhibitor additive during the thermal upgrading process.

When the upgrading is conducted to a pre-refinery location, it is customary to mix the upgraded oil with other produced but not thermally treated crude oils prior to transportation and sale. The other produced but not thermally treated crude oils, can be the same heavy oil from which the upgraded oil is obtained or different crude oils. The other produced but not thermally treated crude oils can be dewatered and or desalted crude oils. By "non-thermally treated" we mean that it is not thermally treated at temperatures in the range of about 250° C. to 500° C. for about 30 seconds to 6 hours. A particular advantage of the upgraded oil of the instant invention is that the presence of a relatively low amount of toluene insoluble (TI) material enables blending of the upgraded oil and other oils in a compatible manner. The mixture of upgraded oil of the instant invention with other compatible oils is a novel and valuable product of commerce. Another feature of the upgraded oil product of the instant invention is that the product can also be mixed with distillates or resids of other crude oils in a compatible manner. The low TI levels in the product enables this mixing or blending.

According to another embodiment of the invention, there is provided a thermal treatment method for upgrading heavy crude oils and crude oil residuum including hydrogen. A bifunctional additive that provides the dual functionality of TI inhibition and catalysis of hydrogenation reactions is added to the crude or crude oil residuum followed by thermal treatment. The thermal treatment comprises treating the bifunctional additized oil at a temperature in the range of about 250° C. to 500° C. in the presence of hydrogen at hydrogen partial pressures of between 500 to 2500 psig for a time between 0.1 to 10 hours to result in an upgraded oil.

Examples of bifunctional additives suitable for thermal treatment method, including hydrogen for upgrading of heavy oils, are polynuclear aromatic sulfonic acid and alkyl polynuclear aromatic sulfonic acid salts of the metals of Group IV-B, V-B, VI-B, VII-B and VIII of the Periodic Table of Elements. The bifunctional additive is represented by the chemical structure:

$$[\text{R-PNA-(X)}_n]_a\text{M}_b$$

wherein PNA is a polynuclear aromatic hydrocarbon containing 2 to 15 aromatic rings; X is a sulfonic acid functionality, n is an integer from 1 to 15 representing the number of sulfonic acid functionality on the PNA hydrocarbon; R is an alkyl group containing from 0 to 40 carbon atoms; M is an element selected from the group consisting of Group IV-B, V-B, VI-B, VII-B and VIII of the Long Form of The Periodic Table of Elements; and a and b are integers each ranging from 1 to 4. The R group can be a linear or branched alkyl group. The aromatic rings can be fused or isolated aromatic rings. Further, the aromatic rings can be homo-nuclear or hetero-nuclear aromatic rings. By homo-nuclear aromatic rings is meant aromatic rings containing only carbon and hydrogen. By hetero-nuclear aromatic ring is meant aromatic rings that contain nitrogen, oxygen and sulfur in addition to carbon and hydrogen.

When the metal component of the bifunctional additive is a Group IV-B metal it may be titanium (Ti), zirconium (Zr), or hafnium (Hf). When the metal is a Group V-B metal it may be vanadium (V), niobium (Nb), or tantalum (Ta). When the metal is a Group VI-B metal it may be chromium (Cr), molybdenum (Mo), or tungsten (W). When the metal is a Group VII-B metal it can be manganese (Mn) or rhenium (Re). When the metal is a Group VIII metal it may be a non-noble metal such as iron (Fe), cobalt (Co), or nickel (ni) or a noble metal such as ruthenium (Ru), rhodium (Rh), palladium (Pd), osmium (Os), iridium (Ir), or platinum (Pt). Preferably, the metal is a Group VI-B metal, most preferably molybdenum.

An effective amount of the bifunctional additive may be oil-miscible or oil-dispersible. It is preferred that the bifunctional additives of the instant invention, by virtue of their molecular structure, exhibit favorable compatibility with asphaltene-rich heavy oils. The bifunctional additives may also be activated under the conditions of the hydroconversion process.

The impact of the bifunctional additive may be augmented by use of mixtures of bifunctional additives of more than one metal. For example, if molybdenum is used, it is desirable to add an additional quantity of cobalt. This is anticipated to yield a positive synergistic effect on catalytic hydrogenation process. Typically, cobalt may be added in an amount from about 0.2 to about 2 mols, preferably about 0.4 mols per mol of molybdenum.

The bifunctional additive can be present in an amount ranging from about 1 to 300 wppm metal, more preferably in the range of about 1 to about 60 wppm of metal based on hydrocarbon oil to be hydroconverted. It is preferred to mix the heavy oil and additive during the thermal treatment upgrading process. Mixing means and process equipment known to one having ordinary skill in the art can be used. Process equipment operable at high pressure, such as high-pressure visbreakers, can be advantageously used to conduct the thermal treatment process in the presence of hydrogen.

The bifunctional additive can be contacted with the heavy oil as is or with use of a carrier solvent. Preferred carrier solvents include aromatic hydrocarbon solvents such as toluene, xylene, crude oil derived aromatic distillates such as Aromatic 150 sold by ExxonMobil Chemical Company, water, alcohols and mixtures thereof. Preferred alcohols are methanol, ethanol, propanol and mixtures thereof. The carrier solvent can range from 10 to 80 weight percent of bifunctional additive and carrier solvent.

Contacting the heavy oil with the bifunctional additive can be achieved at any time prior to thermal treatment. Contacting can occur at the point where the heavy oil is produced at the reservoir, during transportation, or at a refinery location. In the case of crude oil resids, the bifunctional additive is contacted at any time prior to the thermal treatment. After contacting, it is preferred to mix the heavy oil and additive. Any suitable mixing means conventionally known in the art can be used. Non-limiting examples of such suitable mixers include in-line static mixers and paddle mixers. The contacting of the heavy oil and additive can be conducted at any temperature in the range of about 10° C. to 90° C. for an effective amount of time. After contacting and mixing the mixture of heavy oil and additive the mixture can be cooled from about contacting temperature to about ambient temperature, i.e., about 15° C. to about 30° C. Further, the additized-cooled mixture can be stored or transported from one location to another location prior to thermal treatment. Alternately, the additized and cooled mixture can be thermally treated at the location of contacting if so desired. Thermal treatment of the bifunctional additized heavy oil comprises heating said additized heavy oil at a temperature in the range of about 250° C. to about 500° C. in the presence of hydrogen at hydrogen partial pressure of between about 500 to about 2500 psig, for a time between about 0.1 to about 10 hours to result in an upgraded oil product.

The bifunctional additive enhanced hydrotreating upgrading process of the present invention provides an upgraded product that is higher in API gravity compared to the starting feed and lower in toluene insoluble material compared to a hydrotreated upgraded product that is produced in the absence of the bifunctional additive of the instant invention. By virtue of the inhibitor function of the bifunctional additive, the formation of toluene insoluble material is inhibited while facilitating hydroconversion to occur in a facile manner. The upgraded product of the thermal treatment process in the presence of hydrogen has at least 20% less toluene insoluble material compared to the product from a thermal treatment process conducted at the same temperature for the same period of time but in the absence of the bifunctional inhibitor-hydrotreating additive. The upgraded oil of the instant invention comprises the upgraded heavy oil, the added bifunctional additive and products formed from the added bifunctional additive during the thermal upgrading process.

EXAMPLES

The following examples are included herein for illustrative purposes and are not meant to be limiting.

Example 1

Synthesis of Bifunctional Inhibitor-Hydrotreating Additives

As an illustration, two synthetic routes for a molybdenum containing bifunctional additive are described. The bifunc tional molybdenum additive can be synthesized by the method disclosed in GB 1215120A, which is incorporated herein by reference. A reaction mixture is prepared by admixing molybdenyl bis-acetylacetonate and the PNA-sulfonic acid which, in accordance with the stoichiometry of the reaction for forming a molybdenum mono-sulfonic compound, theoretically requires the use of one mol of sulfonic acid for each mol of molybdenyl bis-acetonate present PNA stand for polynuclear. Preferably, the mol ratio of PNA-sulfonic acid to the molybdenyl bis-acetylacetonate is from 5:1 up to 10:1, providing an excess of PNA-sulfonic acid over that required and further enhancing the formation of molybdenum PNA-sulfonate compound. Lower ratios of PNA-sulfonic acid to the molybdenyl bis-acetylacetonate can be used which may range from as low as one mol up to 5 mols of PNA-sulfonic acid per mol of molybdenum bis-acetylacetonate. It is ordinarily necessary when using such lower ratios to effect a thinning of the viscous reaction mixture with an inert organic solvent, such as a mineral oil. The reaction medium is slowly heated from room temperature to a temperature of about 190° C., and thereafter held at a temperature of about 190° C. to about 210° C. for a period of time sufficient to effect removal of acetylacetone, followed by a cooling of the reaction mixture.

In an alternate method of synthesis, molybdenum trioxide and the corresponding PNA-sulfonic acid are mixed in the required stoichiometric ratio in an inert high boiling solvent and heated to temperatures in the range of 150° C. to 200° C. to provide the molybdenum salt of the PNA-sulfonic acid salt as a colloidal suspension in the inert solvent.

Example 2

120 g of bitumen was rapidly heated under nitrogen (350 PSI) to 750° F. with continuous stirring at 1500 RPM. The bitumen was allowed to react under these conditions for a period of time calculated to be equivalent to a short visbreaking run at a temperature of 875° F. (typically 120 to 180 "equivalent seconds"). After achieving the desired visbreaking severity, the autoclave was rapidly cooled in order to stop any further thermal conversion. The gas and liquid products were analyzed and material balanced. The change in boiling point distribution and viscosity reflect the severity of the visbreaking conditions. The toluene insolubles (TI) were measured by quantitative filtration of a fresh hot toluene solution of the visbreaker product (20:1 ratio of toluene to product).

Run-1: In one run 1,3,6-naphthalene trisulfonic acid trisodium salt inhibitor additive (1,3,6-NTSS) was mixed with the bitumen prior to visbreaking. The reaction product was washed with toluene to remove toluene solubles. The resulting toluene insolubles and the inhibitor additive was contacted with water to recover the inhibitor additive, which can be recycled to the visbreaking reaction. A toluene insoluble fraction were left.

Run-2: In a second run 2,6-naphthalene disulfonic acid di-sodium salt (2,6-NDSS) was used as the inhibitor additive and mixed with the bitumen prior to the visbreaking reaction. The resulting visbreaking product was subjected to a water wash to remove the inhibitor additive for recycle. The remainder was contacted with toluene to remove the toluene solubles, thereby leaving a toluene insoluble fraction.

Run-1 and Run-2 are shown schematically in FIG. 1 as scheme-1 and scheme-2 respectively.

Figure 2:
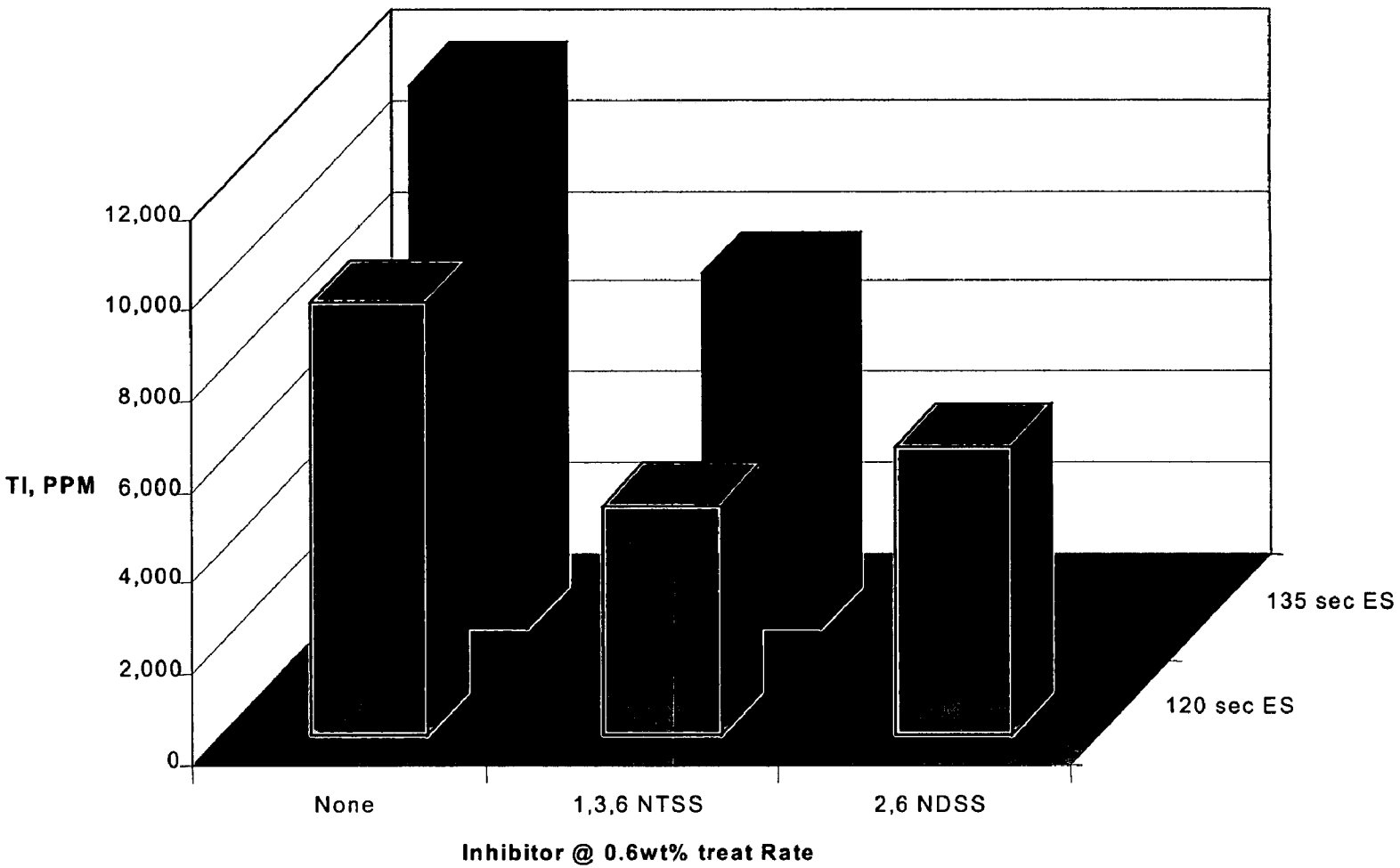
FIG. 2 hereof is a bar graph of toluene insolubles (TI) for thermally treated Athabasca bitumen with no additive labeled none and with two additives 1,3,6-NTSS and 2,6-NDSS FIG. 3 hereof is a is a bar graph of toluene insolubles (TI) for thermally treated Athabasca bitumen with no additive labeled none and with the additive 1,3,6-NTSS worked up according to scheme-1 and scheme-2.
Figure 3:
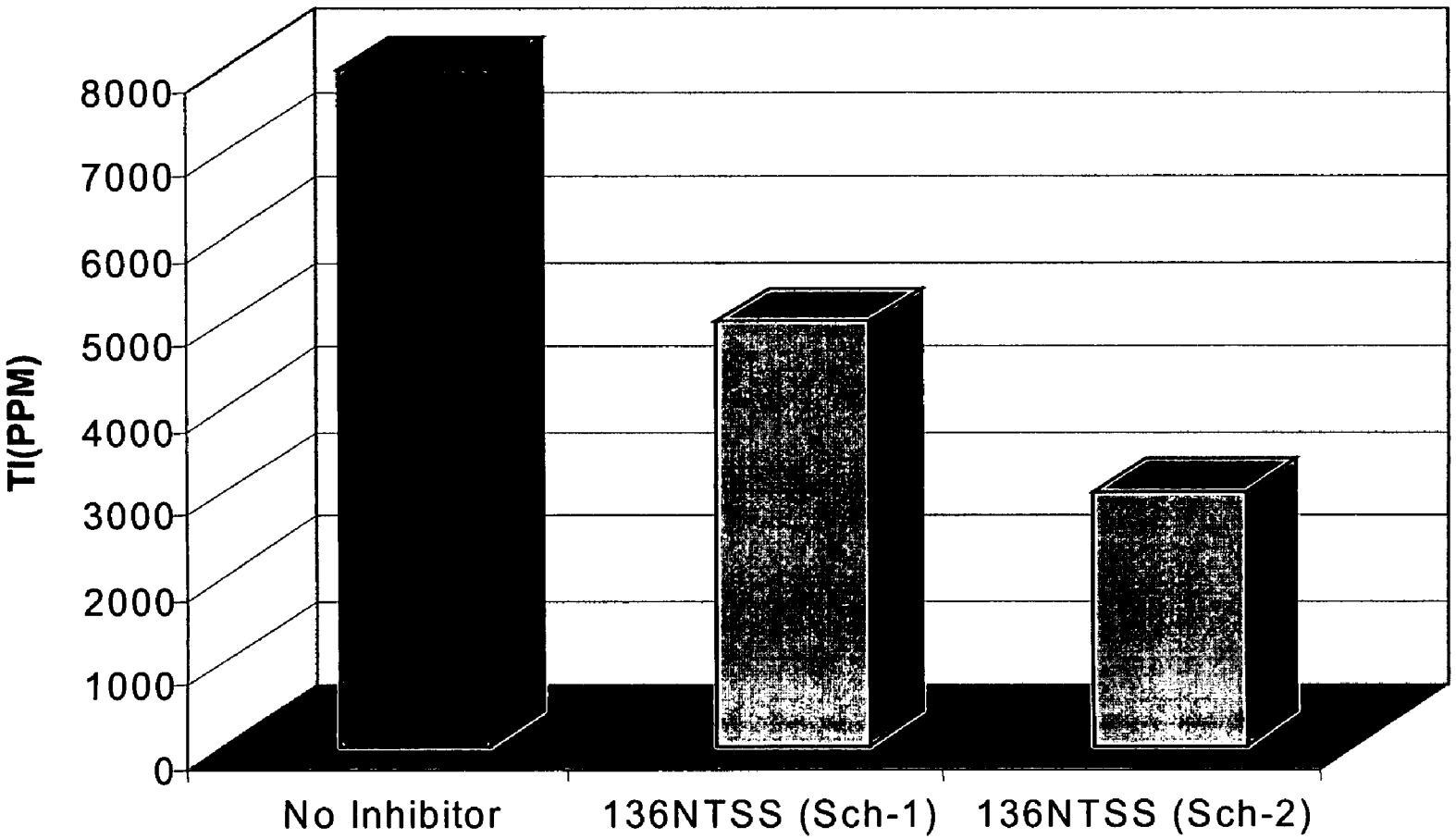

The results of the two runs are shown in FIG. 2 hereof (scheme-1 workup) demonstrates that use of the water-soluble additives 1,3,6-NTSS and 2,6-NDSS at a treat rate of 0.6 wt % based on the weight of oil, results in reduction in coke formation at 120 and 135 equivalent seconds severity. FIG. 3 hereof (scheme-2 workup) depicts results from the water wash experiment. As can be observed, water wash of the visbroken product results in a further reduction in toluene insolubles. Thus, the inhibitors function not only to reduce toluene insolubles but because of their surfactancy property can also extract some of the toluene insolubles into an intermediate oil/water phase.

Results of the analyses of the visbroken products are shown in Tables 1 and 2 below. These visbroken product samples are ones obtained directly from the reactor. We observe a marginal difference in the 700° F.+ conversion between the non-additized and the additized samples. However, we observe a significant reduction in viscosity of the visbroken product in the additized samples relative to the non-additized sample run. These observations suggest the water-soluble inhibitors not only function to reduce the toluene insolubles but also have novel viscosity reduction attributes.

TABLE 1

| Equiv. Sev, sec | 120 | 120 | 120 | 135 | 135 | 135 |
|---|---|---|---|---|---|---|
| Inhibitor | None | 1,3,6-NTSS | 2,6-NDSS | None | 1,3,6-NTSS | 2,6-NDSS |
| 700° F. + Conv., % | 24.93 | 26.67 | 26.82 | 29.03 | 29.04 | 29.87 |

TABLE 2

| Inhibitor | Product Viscosity; cp@40° C. |
|---|---|
| None | 225 |
| 1,3,6-NTSS | 152 |
| 2,6-NDSS | 145 |

The invention claimed is:

1. A method for upgrading heavy oils which method comprises:

a) contacting the heavy oil with an effective amount of a water-soluble inhibitor additive to provide an inhibitor additized heavy oil, which water-soluble inhibitor additive is represented by the chemical structure:

$$Ar—(SO_3^-X^+)_n$$

where Ar is a homonuclear aromatic group of at least 2 rings, and X is selected from Group I (alkali) and Group II (alkaline-earth) elements of the Periodic Table of Elements, and n is an integer from 1 to 5 when an alkali metal is used and from 2-10 when an alkaline earth metal is used;

b) thermally treating said inhibitor additized heavy oil at a temperature in the range of about 250° C. to 500° C. for a time between about 0.1 to 10 hours, thereby resulting in an upgraded the heavy oil;

c) contacting said thermally treated additized heavy oil with water wherein the water-soluble inhibitor additive migrates to the water phase;

d) separating the thermally treated heavy oil from the water phase containing said inhibitor additive;

e) separating the inhibitor additive from the water; and f) recycling said separated inhibitor additive to contacting a heavy oil in step a) above.

2. The method of claim 1 wherein the heavy oil is a vacuum resid.

3. The method of claim 1 wherein X is an alkali metal.

4. The method of claim 3 wherein the alkali metal is sodium.

5. The method of claim 1 wherein the number of rings for Ar is from 2 to 3.

6. The method of claim 4 wherein the number of rings for Ar is from 2 to 3.

7. The method of claim 1 wherein n is 1.

8. The method of claim 6 wherein n is 1.

9. The method of claim 1 wherein the polysulfonic aromatic acid salt is selected from the group consisting of naphthalene-2-sulfonic acid sodium salt, naphthalene-2,6-disulfonic acid sodium salt, naphthalene-1,5-disulfonic acid sodium salt, naphthalene-1,3,6-trisulfonic acid sodium salt, anthraquinone-2-sulfonic acid sodium salt, anthraquinone-1,5-disulfonic acid sodium salt, and pyrene-1,3,6,8-tetra sulfonic acid sodium salt.

10. The method of claim 1 wherein the effective amount of additive is from about 10 to 50,000 wppm based on the weight of the heavy oil.

11. The method of claim 10 wherein the effective amount of additive is from about 20 to 3,000 wppm.

12. The method of claim 8 wherein the effective amount of additive is from about 20 to 3,000 wppm.

13. A method for upgrading a heavy oil, which method comprises:

a) contacting the heavy oil in the presence of hydrogen with an effective amount of a water-soluble inhibitor additive to provide an inhibitor additized heavy oil, which water-soluble inhibitor additive is represented by the chemical structure:

$$[\text{R-PNA-(X)}_n]_a\text{M}_b$$

wherein PNA is a polynuclear aromatic hydrocarbon containing 2 to 15 aromatic rings; X is a sulfonic acid functionality, n is an integer from 1 to 15 representing the number of sulfonic acid functionality on the PNA hydrocarbon; R is an alkyl group containing from 0 to 40 carbon atoms; M is an element selected from the group consisting of Group IV-B, V-B, VI-B, VII-B and VIII of the Long Form of The Periodic Table of Elements; and a and b are integers each ranging from 1 to 4;

b) thermally treating said inhibitor additized heavy oil at a temperature in the range of about 250° C. to 500° C. for a time between about 0.1 to 10 hours;

c) contacting said thermally treated additized heavy oil with water wherein the water-soluble inhibitor additive migrates to the water phase;

d) separating the thermally treated heavy oil from the water phase containing said water-soluble inhibitor additive;

e) separating the inhibitor additive from the water; and f) recycling said separated inhibitor additive to contacting a heavy oil in step a) above.

14. The method of claim 13 wherein the heavy oil is a vacuum resid.

15. The method of claim 13 wherein X is an alkali metal.

16. The method of claim 13 wherein the alkali metal is sodium.

17. The method of claim 13 wherein the number of rings for Ar is from 2 to 3.

18. The method of claim 17 wherein the number of rings for Ar is from 2 to 3.

19. The method of claim 13 wherein M is a molybdenum.

20. The method of claim 13 wherein n is 1.

21. The method of claim 19 wherein n is 1.

22. The method of claim 13 wherein the polysulfonic aromatic acid salt is selected from the group consisting of naphthalene-2-sulfonic acid sodium salt, naphthalene-2,6-disulfonic acid sodium salt, naphthalene-1,5-disulfonic acid sodium salt, naphthalene-1,3,6-trisulfonic acid sodium salt, anthraquinone-2-sulfonic acid sodium salt, anthraquinone-1,5-disulfonic acid sodium salt, and pyrene-1,3,6,8-tetra sulfonic acid sodium salt.

23. The method of claim 13 wherein the effective amount of additive is from about 10 to 50,000 wppm based on the weight of the heavy oil.

24. The method of claim 13 wherein the effective amount of additive is from about 20 to 3,000 wppm.

* * * * *